US005459980A

United States Patent [19]

Kenney et al.

[11] Patent Number: 5,459,980

[45] **Date of Patent: * Oct. 24, 1995**

[54] MANUFACTURING INFUSION PACKAGES

[75] Inventors: Alan G. Kenney; John D. Wood, both of Cambridgeshire, England

[73] Assignee: A.G. (Patents) Limited, London, England

[ * ] Notice: The portion of the term of this patent subsequent to Aug. 10, 2010 has been disclaimed.

[21] Appl. No.: 100,564

[22] Filed: Jul. 30, 1993

Related U.S. Application Data

[63] Continuation-in-part of Ser. No. 633,054, Feb. 25, 1991, Pat. No. 5,233,813.

[30] Foreign Application Priority Data

Apr. 28, 1989 [GB] United Kingdom ..... 8909846

[51] Int. Cl.[6] ..... B65B 29/02; B65B 9/02

[52] U.S. Cl. ..... 53/450; 53/453; 53/553; 53/559; 53/373.4

[58] Field of Search ..... 53/553, 560, 559, 53/370.4, 373.4, 450, 453, 454

[56] References Cited

U.S. PATENT DOCUMENTS

| | | | |
|---|---|---|---|
| 1,654,647 | 1/1928 | Heist | 53/560 X |
| 2,690,038 | 9/1954 | Stirn et al. | 53/560 X |
| 2,690,802 | 10/1954 | Russell . | |
| 2,695,483 | 11/1954 | Toews | 53/559 X |
| 2,789,640 | 4/1957 | Belden . | |
| 3,736,722 | 6/1973 | Rosenberg | 53/553 X |
| 4,437,294 | 3/1984 | Romagnoli | 53/553 |
| 4,571,924 | 2/1986 | Bahrani | 53/559 X |
| 4,614,076 | 9/1986 | Rathemacher | 53/560 X |
| 4,747,250 | 5/1988 | Rossi | 53/553 X |
| 4,782,647 | 11/1988 | Williams et al. | 53/560 X |
| 5,081,819 | 1/1992 | Cloud | 53/559 X |
| 5,233,813 | 8/1993 | Kenney et al. | 53/450 |

*Primary Examiner*—Horace M. Culver
*Attorney, Agent, or Firm*—Charles E. Baxley

[57] ABSTRACT

A method and apparatus for manufacturing infusion packages such as tea or coffee bags of predetermined shape, comprises means for dosing discrete piles (7) of infusion on a first moving web (4), means (8) for sealing a second web (5) over the first to form a consolidated web with discrete infusion containing pockets (3), a co-rotating roller cutting device having cutting means and recess means to cut packages of predetermined shape e.g. circular from the web, a suction device (15) for collecting waste web and maintaining downstream web tension to transport the cut packages to a removal device (50, 51) operable to stamp the packages downwardly into stacking chambers (49).

36 Claims, 3 Drawing Sheets

MANUFACTURING INFUSION PACKAGES

The present Application is a continuation-in-part Application with respect to a U.S. patent application 07/633,054 filed Feb. 25, 1991 which issued on Aug. 10, 1993 as Ser. No. 5,233,813.

The present invention is generally concerned with infusion packages such as tea and coffee bags and similar bags containing herbal or other infusions. In particular the invention relates to an apparatus for and a method of manufacturing infusion packages and to a novel form of infusion package made by such apparatus and method.

A known method and apparatus for producing infusion packages such as tea bags, comprises dosing discrete piles of infusion at spaced intervals onto a rapidly moving paper web, and sealing a second web over the first web to produce a two ply web having a plurality of discrete pockets containing infusion. The web is then severed by means of laterally and longitudinally orientated knives into individual packages, or pairs of packages separated by a serrated cut, for discharge or packing. Such a method enables continuous fabrication of infusion packages at a very high production rate which is essential for the cost-effective manufacture of e.g. tea bags for sale in the general market place.

As discussed above, in known apparatus of this type the packages are severed from the two ply web by knives and as a consequence the infusion packages are square or rectangular, the pocket spacings and web dimensions being such that the entire web is cut into the individual packages or package pairs without leaving any waste web. For this reason, infusion packages such as tea and coffee bags which have been mass produced at high production rates for sale on the general market have traditionally been rectangular.

Recently, it has been proposed to produce non-rectangular infusion packages. WO 88/08394 (Hurst) discloses an orbital punch and die system for producing circular infusion packages. Such a system is, however, slow and therefore unsuited to mass production.

It is an object of the present invention to provide an apparatus and method for producing non-rectangular infusion packages at a high rate.

Viewed from a first aspect, the invention provides an apparatus for manufacturing infusion packages of non-rectangular shape comprising:

(a) means for producing a travelling two-ply web of porous tissue material having a plurality of discrete pockets each containing a measure of infusion;

(b) a web-cutting device comprising:

(i) a pair of opposed cutting rollers having a plurality of recess means for receiving therein a plurality of successive said pockets; and (ii) cutting means provided on at least one of said rollers and associated with said recess means for cutting each said pocket into an individual package, said cutting means comprising a cutting edge which defines said non-rectangular shape for substantially an entire outer peripheral edge of each package, whereby waste web substantially surrounds said packages;

(c) means for moving said waste web away from said cutting device so as to transport said packages to a position downstream of said cutting device; and (d) package removing means located at said downstream position for removing said cut-out packages from said web.

Viewed from a second aspect, the invention provides an apparatus for manufacturing infusion packages of non-rectangular shape comprising:

(a) dosing means for dosing infusion in discrete measures onto a first moving web;

(b) sealing means synchronised with the dosing means for sealing a second moving web over said first moving web to produce a travelling two-ply web having a plurality of discrete pockets each containing one of the measures of infusion;

(c) a web-cutting device comprising:

(i) a pair of opposed cutting rollers having a plurality of recess means for receiving therein a plurality of successive said pockets; and (ii) cutting means provided on at least one of said rollers and associated with said recess means for cutting each said pocket into an individual package, said cutting means comprising a cutting edge which defines said non-rectangular shape for substantially an entire outer peripheral edge of each package, whereby waste web substantially surrounds said packages;

(d) means for moving said waste web in a generally horizontal direction from said cutting device so as to transport said packages to a position downstream of said cutting device;

(e) package removing means located at said downstream position for removing said cut-out packages from said web; and (f) package stacking means below said package removal means for receiving and stacking horizontally said packages removed from the web.

Viewed from a third aspect the invention provides a method of manufacturing infusion packages of a non-rectangular shape comprising steps as follows:

producing a travelling two-ply web of porous tissue material having a plurality of discrete infusion filled pockets each containing one measure of infusion;

cutting said two-ply web into packages having said non-rectangular shape and each including one of the pockets by passing the two-ply web through a cutting device having co-operating co-rotating rollers with recess means which accommodate successive of the pockets and providing cutting means arranged around said recess means for cutting out each said package with said predetermined shape such that waste web substantially surrounds the cut-out packages;

moving the two-ply web away from the cutting device so as to transport the packages to a location downstream of said cutting device; and removing said cut-out packages from the travelling two-ply web at said location.

Viewed from a fourth aspect, the invention provides a method of manufacturing infusion packages of a non-rectangular shape comprising steps as follows:

dosing an infusion in discrete measures onto a first moving web;

sealing a second moving web over said first moving web to produce a travelling two-ply web having a plurality of discrete infusion filled pockets each containing one of the measures of infusion;

cutting said two-ply web into packages having said non-rectangular shape and each including one of the pockets by passing the two-ply web through a cutting device having co-operating co-rotating rollers with recess means which accommodate successive of the pockets and providing cutting means arranged around said recess means for cutting out each said package with said predetermined shape such that waste web substantially surrounds the cut-out packages;

moving the two-ply web away from the cutting device so as to transport the packages generally horizontally to a location downstream of said cutting device;

removing said cut-out packages from the travelling two-ply web at said location; and stacking said cut-out packages such that they lie generally horizontally one above the other in a stacking means provided beneath said location.

Such an apparatus and method represents a completely new departure from the prior art in that, whilst a continuous high speed production rate may be maintained, infusion packages such as tea bags can be provided with shapes other than rectilinear. The presently preferred packages are substantially round, and a preferred embodiment of the invention has enabled for the first time manufacture of substantially round tea bags at a cost-effective high production rate for sale on the general market place, such tea bags being attractive to the consumer.

This is made possible by using the waste web which surrounds the packages to transport the packages to a removal station in a controlled manner. By surrounding the packages, the web controls closely the position of the packages, which means that they may be presented accurately to the removal means.

A particularly advantageous arrangement is one in which the web is transported horizontally from the cutting device, to a package removing means at which the packages are pushed downwardly from the web into package stacking means arranged therebelow. This allows vertical stacks of horizontally arranged packages to be formed, which can then be deposited into a carton. This is particularly efficient and minimises carton sizes.

To improve the positional control exerted by the waste web on the packages as they are moved, the cutting device may be such that it leaves a frangible connection between the package and the web, this connection subsequently being broken, advantageously by the package removal means as the package is removed from the web. In one arrangement, the cutter may be arranged so as not to cut through the entire thickness of the web, so as to leave the packages attached to the web by a thin frangible ring. This may be achieved by suitably varying the cutting pressure applied to the cutting rollers.

To maximise production rate, the rollers preferably have a plurality of recesses and corresponding cutting means arranged both circumferentially and in the width direction. This allows a substantial number of packages to be produced per revolution of the rollers. The number of cutting means may vary, e.g. 2 to 10 around the circumference and 1 to 5 across the width of a roller.

In one embodiment the recess means comprises recesses formed on both rollers, and the relative angular orientation of the rollers is such that the or each recess pair on the respective rollers co-operate to form together a recess for accommodating the pockets on the webs, as they pass between the rollers. It is also possible that recesses may be formed only on one of the rollers with the other roller being plain.

It is envisaged that a cutting edge on one roller could bear on a resilient surface of the other. Preferably, however, the cutting means is formed by a lip or ridge raised around the recess of one of the rollers (the cutting roller), the lip or ridge co-operating with a hard smooth surface of the opposed roller (anvil roller). The lip or ridge defines the predetermined shape of the packages. Preferably the smooth surface is provided around a recess on the anvil roller.

In a preferred embodiment the sealing means comprises co-rotating heated rollers through which the webs are passed and which, as with known machines of this type, include raised areas which define the seal areas, the webs including suitable thermoplastic materials for heat sealing. In accordance with the invention the raised areas preferably define a seal shape which matches the predetermined shape of the packages e.g. round.

The cutting rollers and sealing rollers are preferably separate and are synchronised with each other to ensure that the sealed pockets produced by the sealing rollers engage correctly with the cutting rollers so that the cutting may be performed only on the sealed portions of the web leaving a continuously sealed area around the perimeter of the package of predetermined width and controlled tolerance. To this end, the sealing and cutting rollers have synchronised speeds, with the phase and relative lateral position of the cutting rollers preferably being adjustable with respect to the sealing rollers. As discussed, the seal produced between the webs preferably matches the shape of the final packages. Thus, for circular packages, a circular seal preferably surrounds each pocket of infusion.

As discussed above, with known techniques for producing rectilinear packages, the whole of the two ply web is effectively converted into packages and no waste web is produced. In accordance with the invention, on the other hand, web remaining after the packages have been severed is collected so that the integrity of the web may be maintained before and after the cutting operation. The waste is effective to transport the packages to the package removing means. A particularly preferred collecting means comprises a suction system which is advantageously adjustable to provide desired tensioning of the web downstream of the cutting device and which may include a slot like inlet end for receiving the moving web communicating with a conduit for waste removal. A roller system may also be used which drivingly engages the web.

In a preferred embodiment, the package removing means comprises a reciprocating stamping member or members whose movement is synchronised with the movement of the cutting device, the member or members urging the packages from the moving web, preferably downwardly into a stacking chamber arranged below. From the stacking chamber, the packages may be transferred automatically to cartons or boxes. The lower ends of the stamping members which engage the packages are preferably of smaller cross-section than the packages so that the members do not foul on the web material surrounding the packages as the packages are stamped from the web. The two ply web preferably is supported by platforms upstream and downstream of the cutting device, the downstream platform being apertured or interrupted beneath the package removing means to permit downward displacement of packages from the moving tensioned web downstream of the cutting device. The use of a downstream web support platform itself represents a completely new departure from known apparatus in which all of the web is cut into packages and therefore no web support has been provided downstream of the cutters.

The dosing means for the infusion may comprise a dosing roller synchronised with the sealing rollers of the preferred embodiment in a known manner.

The invention extends to an infusion package, such as a substantially round tea or coffee bag, made by the aforesaid method and apparatus.

The preferred web collection system discussed above itself represents a completely new departure from the prior art in the context of infusion package manufacture, which may have application independently of the above aspects of the invention e.g. if a reciprocating punch cutting means was used in place of the roller cutting device. Accordingly, a still further aspect of the invention provides an apparatus for manufacturing infusion packages of non-rectangular shape comprising:

(a) dosing means for dosing infusion in discrete measures onto a first moving web;

(b) sealing means synchronised with the dosing means for sealing a second moving web over said first moving web to produce a travelling two-ply web having a plurality of discrete pockets each containing one of the measures of infusion;

(c) a web-cutting device comprising a cutting edge which defines said non-rectangular shape for substantially an entire outer peripheral edge of each package, whereby waste web substantially surrounds said packages;

(d) suction means arranged downstream of the cutting device for collecting the waste web; and (e) package removal means arranged in the path of travel of the web between the cutting device and the suction means for removing packages from the travelling web.

The invention extends to a method of manufacturing infusion packages of a non-rectangular shape comprising steps as follows:

dosing an infusion in discrete measures onto a first moving web;

sealing a second moving web over said first moving web to produce a travelling two-ply web having a plurality of discrete infusion filled pockets each containing one of the measures of infusion;

cutting said two-ply web into packages having said non-rectangular shape and each including one of the pockets by passing the two-ply web through a cutting device having means for cutting out each said package with said predetermined shape such that waste web substantially surrounds the cut-out packages; and feeding the web to suction collection means arranged downstream of the cutting device through package removal means arranged between the cutting device and the suction device, said package removal means removing said packages from said web.

From a yet further aspect the invention provides a method of manufacturing circular infusion packages comprising steps as follows:

producing a travelling two-ply web having a plurality of discrete infusion filled pockets each containing one of the measures of infusion;

cutting said two-ply web into said circular packages having said each including one of the pockets by passing the two-ply web through a cutting device having means for cutting out each said package such that waste web substantially surrounds the cut-out packages;

removing said packages from said web; and feeding the waste web to suction collection means arranged downstream of the cutting device.

From yet another aspect the invention provides a method of manufacturing circular infusion packages comprising steps as follows:

producing a travelling two-ply web of porous tissue material having a plurality of discrete infusion filled pockets each containing one of the measures of infusion;

cutting said two-ply web into said circular packages each including one of the pockets by passing the two-ply web through a cutting device having cooperating co-rotating rollers with recess means which accommodate successive of the pockets and providing cutting means arranged around said recess means for cutting out each said package such that waste web substantially surrounds the cut-out packages;

removing said cut-out packages from the travelling two-ply web; and collecting the waste web.

A preferred embodiment of the invention, for manufacturing circular tea bags, will now be described, by way of example only, with reference to the accompanying drawings wherein.

Figure 1:
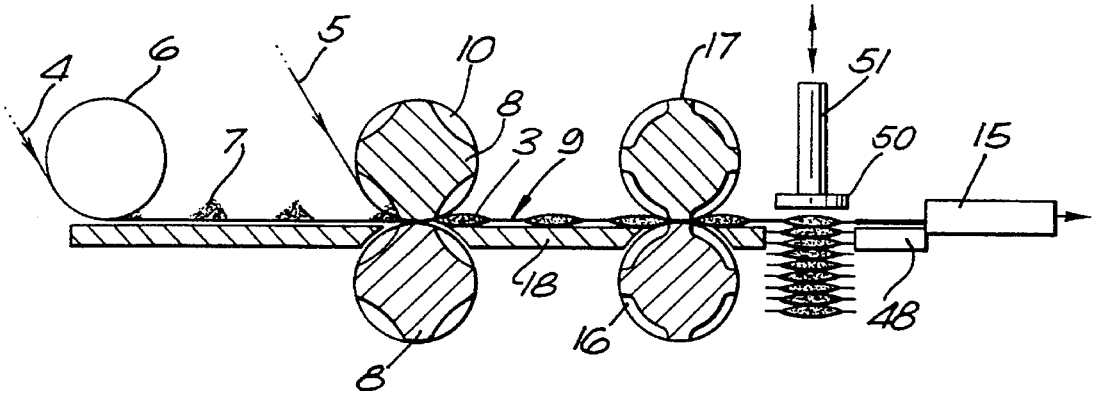
FIG. 1 shows, schematically, in side elevation, apparatus in accordance with the invention.

With reference to FIG. 1, a web 4 of heat sealable filter paper is fed around a roller 6 of a dosing device (of known type) which deposits discrete piles of tea 7 on the moving web. Web 4 and a second moving filter web 5 are then brought together and pass through the nip of heated co-rotating sealing rollers 8, driven in synchronisation with roller 6, which join the strips together to form a two ply web 9 having discrete sealed pockets 3 containing tea. This general arrangement is known in the art and will not accordingly be discussed in more detail here.

Figure 3:
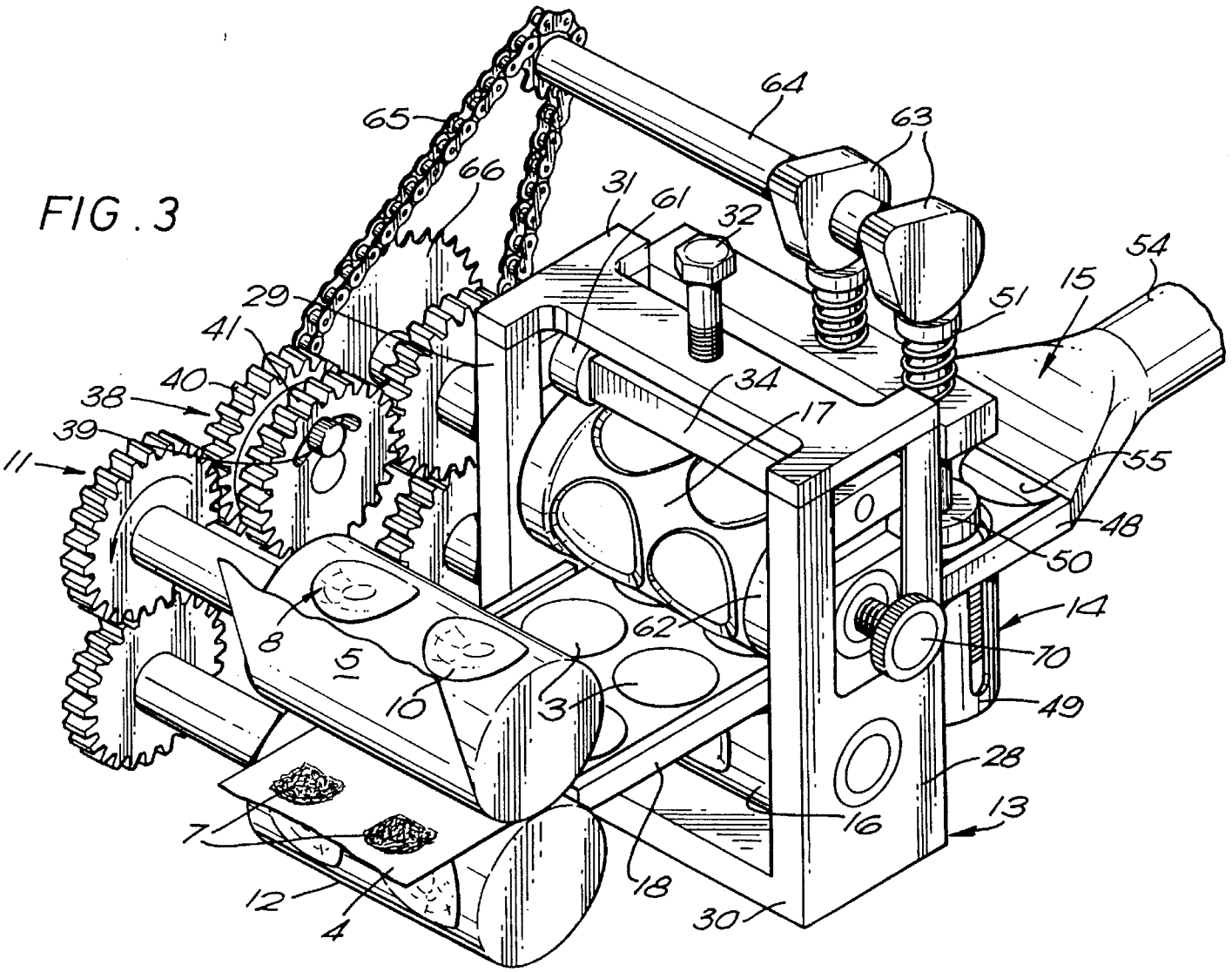
FIG. 3 is a view similar to FIG. 2 but showing other components of the preferred embodiment.

FIG. 3 shows the heated rollers 8 suitable for use in the present embodiment for producing substantially circular tea bags. Each roller 8 is provided with two rows of substantially circular pockets 10 arranged at equispaced intervals around the periphery of the roller. Of course, other numbers or arrangements of pockets would be quite possible. The rollers are rotatably carried by suitable bearing means (not shown) and driven via an intermeshing sprocket arrangement 11. In operation, as the rollers rotate, the raised portions 12 surrounding the pockets 10 pinch the webs 4 and 5 together and by virtue of their heat melt a sealing material, for example polypropylene, provided on the webs to form a two ply web having a plurality of discrete sealed pockets 3 containing tea. The operation of the sealing rollers is synchronised (in a known manner) with that of the dosing device 6 so that the tea doses deposited on the web 4 are surrounded by the pockets 10 during the heat sealing.

After the consolidated two ply web 9 leaves the sealing means 8, it passes to a cutting device 13, which will be described in more detail later. The cutting device 13 cuts substantially circular bags from the web 9 which will however still surround the bags after they leave the cutting device 13. The bags are transported by the web in this manner to a stacking and packing station 14, which will be described in greater detail later in the specification. When the bags have been separated from the web, the waste web material is removed by a suction device 15.

Figure 4:
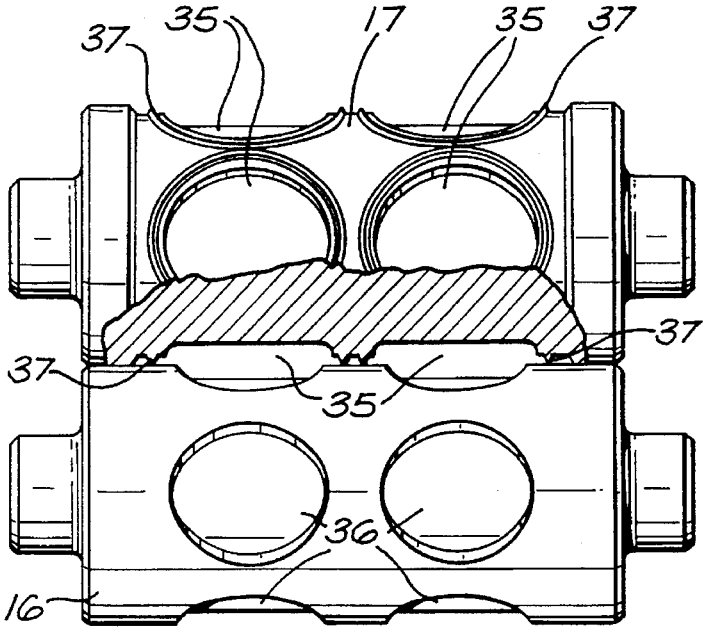
FIG. 4 shows in front elevation the cutting rollers of FIG. 3.
Figure 2:
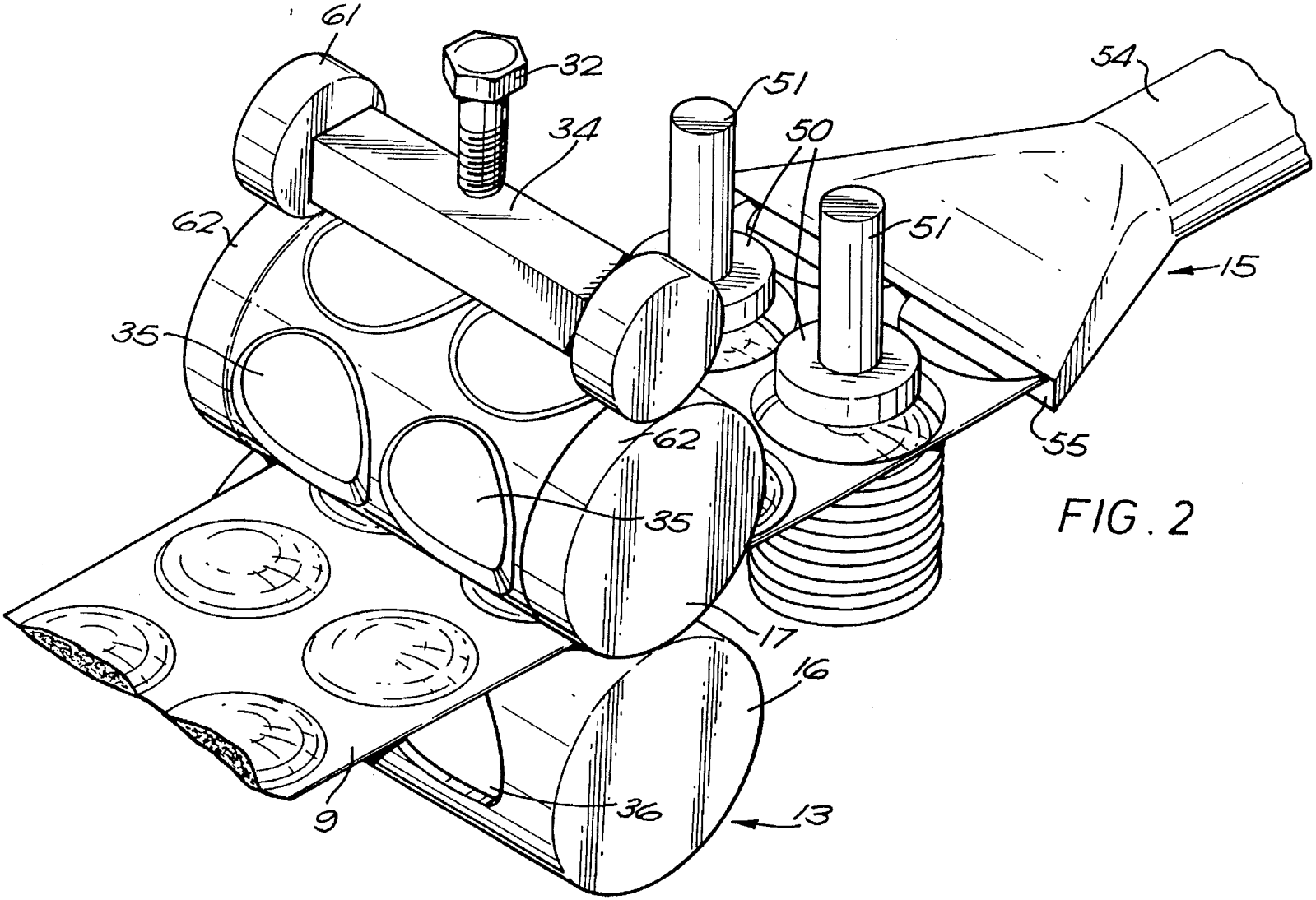
FIGS. 2 is a schematic perspective view of the apparatus with certain parts removed for clarity.

Returning now to the cutting device 13, this is shown in greater detail in FIGS. 2, 3 and 4. The cutting device comprises two co-operating, co-rotatable rollers 16, 17. The web 9 is fed into the pinch between the rollers along an entry platform 18.

The roller 17 is supported on a bearing which locates in vertical slots (not shown) running down the length of the opposed limbs 28, 29 of a support housing 30, with the upper roller 17 resting on the lower roller 16 which is carried by a fixed bearing. A clamp plate 31 is connected across the top of the limbs 28, 29 and mounts a threaded bolt 32 in a threaded bore. This bolt 32 acts via a pressure roller assembly 34 on the cutting rollers 16, 17, so that the contact pressure between the rollers 16, 17 may be raised or lowered by either tightening or loosening the bolt 32. The pressure roller assembly comprises rollers 61 at each end which act on the outer portions 62 of the cutting roller 17.

The design of the rollers 16, 17 can be clearly seen from FIG. 4. Both rollers 16, 17 have a plurality of recesses 35, 36 formed in their respective surfaces, in two rows, the recesses in each row being equispaced around the respective roller circumference. The recesses are substantially circular in shape and are of approximately the same maximum depth but of somewhat different cross-section. They could be of different depths or shapes depending on the particular shape of bag being produced. The recesses 35 on the upper roller 17 are of greater area than those 36 on the lower roller 16 and will thus completely overlie those recesses as the rollers rotate and co-operate. They could instead be of the same area or smaller than those on the lower roller without changing the operational principles. The recesses 35, 36 co-operate to provide spaces for accommodating the tea containing portions of the pockets formed in the web 3. As described in the introduction, the number of recesses can vary. The illustrated cutting and sealing rollers are of similar diameter, but these may be different with the relative rotation speeds adjusted accordingly.

A substantially circular cutting edge 37 is formed around each recess 35 on the upper roller which therefore acts as a cutting roller. This edge 37 is constituted by a relatively low and narrow raised lip running around the recess. The top of the lip is sufficiently sharp to provide the desired cutting effect as a result of the pressure acting on the lip during cutting by virtue of the contact pressure set by the adjusting bolt 32. The cutting edges 37 bear against the smooth surface around the recesses 36 of the lower roller 16 which effectively acts as a rotating anvil. With exactly circular cutting edges the resultant bags may be very slightly elliptical as a result of stretching of the web as it passes through the cutting rollers. This may not be readily noticeable, but could be compensated for by making the cutting edges slightly elliptical if desired.

In the cutting operation, the web 9 having discrete sealed pockets containing tea passes successively between the rollers 16, 17. The cutting edge 37 acts with the anvil surface on roller 16 to cut out the bag, the space formed between the respective recesses 35 and 36 accommodating the tea containing portion of the bag, as it is cut. The packages need not be cut completely from the web 3 by the cutting edge 37, but may be left attached thereto by a frangible connection. For example the cutting edges 37 need not cut completely through the thickness of the web material, so as to leave a thin frangible ring which will be later broken as the packages are removed from the web. This incomplete cut may be achieved by suitably varying the cutting pressure, for example.

To ensure satisfactory operation, the speed of rotation of the rollers 16, 17 is linked to that of the sealing rollers 8 by suitable gearing mechanism 38 shown schematically in FIG. 3. The position of the cutting rollers 16,17 is variable laterally with respect to the sealing rollers 8. To this end, an adjustment wheel 70 is threadedly engaged in housing arm 28. When the wheel 70 is screwed in or out, the roller 17 moves laterally in the housing 30. The relative phase of the sealing rollers 8 and cutting rollers 16,17 may be adjusted by means of a clamping screw in slot arrangement 39 which releaseably interengages a pair of intermediate sprockets 40,41 meshing with the drive sprockets for the respective sets of rollers.

By proper setting of the relative lateral position and phase of the cutting rollers, the tea containing pockets on the web 9 will enter the cutting device correctly with the tea bearing portions accommodated within the recesses 35, 36 of the rollers 16, 17 and the sealed portions extending outwardly thereof to be cut by the cutting edge 37.

After the web 9 has been cut into individual bags, the bags are carried out of the cutting device 13 both by the momentum imparted by the cutting rollers 16, 17 and by the waste web material which still surrounds the bags and is placed in tension by the suction device 15.

After leaving the cutting means, the bags pass to the stacking station 14. This comprises stacking chambers 49 arranged side by side and open at their tops. The web in this region is supported by a further platform 48 which is apertured above the stacking chambers. As the bags pass over the tops of the chambers, they are pushed into the chambers by stamper members 50. This action will also break any frangible connection between the packages and the web. These members, which are preferably circular in section and of smaller diameter than the tea bags, are mounted on the end of shafts 51 which reciprocate up and down. If other shaped bags are produced the section of the members preferably matches the bag shape. When a predetermined number of bags have entered the chambers 49, the stacks then are released from the bottom of the stacker into boxes (not shown). As shown in FIG. 3, the upper ends of the shafts 51 of the stamper members 50 are resiliently engaged with rotating cam members 63 carried by cam shaft 64 which is coupled to the drive sprocket mechanism 38 via chain drive 65 which engages with a sprocket wheel 66 mounted on the drive shaft of the upper cutting roller 17. In this way the reciprocal movement of the stampers may be synchronised with the rotation of the cutting rollers. Power drive to the system can be imparted via any one of the drive sprockets of the mechanism 38.

Immediately after the stacking station is a waste web removal device 15. This comprises a conduit 54, which tapers to a slot like open mouth 55 at one end, extending across the web travel path and which communicates with a suction device (not shown) at the other end. This allows for an easy and effective removal of waste from the apparatus and, moreover, maintains the tension in the web downstream of the cutting device to provide transport means for the cut out packages as described above.

The preferred embodiment can achieve a high production rate of bags, for example 1,200 to 2,500 per minute for the "two lane" web illustrated. The rollers are all rotated at high speeds, which may vary depending on roller sizes which can also vary. Speeds in the range of 200 to 500 rpm have been used in practice.

While the invention has been described with reference to production of substantially circular tea bags, it is of course applicable to other infusion packages and other shapes. Also, while the above embodiment describes cutting rollers which are each formed with recesses and which are driven together by intermeshed gearing, it will be appreciated that in another embodiment, recesses could be formed only on the cutting roller 17 with the roller 16 being plain. In such a case it is possible to dispense with the gearing between the rollers 16, 17 and to allow the roller 16 to be driven by friction.

We claim:

1. An apparatus for manufacturing infusion packages of non-rectangular shape comprising:

(a) means for producing a travelling two-ply web of porous tissue material having a plurality of discrete pockets each containing a measure of infusion;

(b) a web-cutting device comprising:

(i) a pair of opposed cutting rollers having a plurality of recess means for receiving therein a plurality of successive said pockets; and (ii) cutting means provided on at least one of said rollers and associated with said recess means for cutting each said pocket into an individual package, said cutting means comprising a cutting edge which defines said non-rectangular shape for substantially an entire outer peripheral edge of each package, whereby waste web substantially surrounds said packages;

(c) means for moving said waste web away from said cutting device so as to transport said packages to a position downstream of said cutting device; and (d) package removing means located at said downstream position for removing said cut-out packages from said web.

2. An apparatus for manufacturing infusion packages of non-rectangular shape comprising:

(a) dosing means for dosing infusion in discrete measures onto a first moving web;

(b) sealing means synchronised with the dosing means for sealing a second moving web over said first moving web to produce a travelling two-ply web having a plurality of discrete pockets each containing one of the measures of infusion;

(c) a web-cutting device comprising:

(i) a pair of opposed cutting rollers having a plurality of recess means for receiving therein a plurality of successive said pockets; and (ii) cutting means provided on at least one of said rollers and associated with said recess means for cutting each said pocket into an individual package, said cutting means comprising a cutting edge which defines said non-rectangular shape for substantially an entire outer peripheral edge of each package, whereby waste web substantially surrounds said packages;

(d) means for moving said waste web in a generally horizontal direction from said cutting device so as to transport said packages to a position downstream of said cutting device;

(e) package removing means located at said downstream position for removing said cut-out packages from said web; and (f) package stacking means below said package removal means for receiving and stacking horizontally said packages removed from the web.

3. The apparatus as claimed in claim 1 or 2 wherein the cutting means leaves a frangible connection between each respective infusion containing pocket and the surrounding waste web.

4. The apparatus as claimed in claim 3 wherein said frangible connection is broken by the package removing means as the package is removed from the web.

5. The apparatus as claimed in claim 4 wherein said cutting means cuts only through a limited thickness of the web to leave a thin frangible ring around each package.

6. The apparatus as claimed in claim 1 or 2, wherein the package removing means comprise a reciprocating stamping member whose movement is synchronized with that of the cutting device, the stamping member urging successive packages into said stacking means.

7. The apparatus as claimed in claim 6 wherein a lower end of the stamping member has a smaller cross section than that of the packages.

8. The apparatus as claimed in claim 2 further comprising a platform extending downstream of said cutting device to support said web downstream of said cutting device.

9. The apparatus as claimed in claim 1 or 2 in which the recess means comprise recesses provided on both of said opposed rollers.

10. The apparatus as claimed in claim 1 or 2 in which the recess means comprise recesses provided on only one of said opposed rollers.

11. The apparatus as claimed in claim 1 or 2 in which the cutting means are formed by a lip raised around the recess means, the lip engaging a hard smooth surface of the other roller.

12. The apparatus as claimed in claim 2, wherein the sealing means comprise a pair of opposed heated rollers separate from and synchronized for rotation with the cutting rollers.

13. The apparatus as claimed in claim 1 or 2 wherein the means for moving the waste web comprise a suction means.

14. The apparatus as claimed in claim 1 or 2 wherein said means for moving said waste web comprise rollers drivingly engaging the web.

15. The apparatus as claimed in claim 1 or 2 further comprising suction means for collecting the waste web.

16. A method of manufacturing infusion packages of a non-rectangular shape comprising steps as follows:

producing a travelling two-ply web of porous tissue material having a plurality of discrete infusion filled pockets each containing one of the measures of infusion;

cutting said two-ply web into packages having said non-rectangular shape and each including one of the pockets by passing the two-ply web through a cutting device having co-operating co-rotating rollers with recess means which accommodate successive of the pockets and providing cutting means arranged around said recess means for cutting out each said package with said predetermined shape such that waste web substantially surrounds the cut-out packages;

transporting the two-ply web away from the cutting device so as to transport the packages to a location downstream of said cutting device; and removing said cut-out packages from the travelling two-ply web at said location.

17. A method of manufacturing infusion packages of a non-rectangular shape comprising steps as follows:

dosing an infusion in discrete measures onto a first moving web;

sealing a second moving web over said first moving web to produce a travelling two-ply web having a plurality of discrete infusion filled pockets each containing one of the measures of infusion;

cutting said two-ply web into packages having said non-rectangular shape and each including one of the pockets by passing the two-ply web through a cutting device having co-operating co-rotating rollers with recess means which accommodate successive of the pockets and providing cutting means arranged around said recess means for cutting out each said package with said predetermined shape such that waste web substantially surrounds the cut-out packages;

transporting the two-ply web away from the cutting device so as to transport the packages generally horizontally to a location downstream of said cutting device;

removing said cut-out packages from the travelling two-ply web at said location; and stacking said cut-out packages such that they lie generally horizontally one above the other in a stacking means provided beneath said location.

18. The method as claimed in claim 16 or 17 wherein the cutting means leaves a frangible connection between each package and its surrounding web, and including the step of breaking said frangible connection.

19. The method as claimed in claim 18 wherein the frangible connection is broken as the packages are removed from the web.

20. The method as claimed in claim 18 wherein the cutting means does not cut through the full thickness of the web so as to leave a frangible ring around each package.

21. The method as claimed in claim 16 or 17 wherein the waste web is transported from the cutting device by suction.

22. The method as claimed in claim 16 or 17 wherein the waste web is transported from the cutting device by rollers.

23. The method of claim 16 or 17 wherein the waste web is collected by suction means.

24. An apparatus for manufacturing infusion packages of non-rectangular shape comprising:

(a) dosing means for dosing infusion in discrete measures onto a first moving web;

(b) sealing means synchronised with the dosing means for sealing a second moving web over said first moving web to produce a travelling two-ply web having a plurality of discrete pockets each containing one of the measures of infusion;

(c) a web-cutting device comprising a cutting edge which defines said non-rectangular shape for substantially an entire outer peripheral edge of each package, whereby waste web substantially surrounds said packages;

(d) suction means arranged downstream of the cutting device for collecting the waste web; and (e) package removal means arranged in the path of travel of the web between the cutting device and the suction means for removing packages from the travelling web.

25. A method of manufacturing infusion packages of a non-rectangular shape comprising steps as follows:

dosing an infusion in discrete measures onto a first moving web;

sealing a second moving web over said first moving web to produce a travelling two-ply web having a plurality of discrete infusion filled pockets each containing one of the measures of infusion;

cutting said two-ply web into packages having said non-rectangular shape and each including one of the pockets by passing the two-ply web through a cutting device having means for cutting out each said package with said predetermined shape such that waste web substantially surrounds the cut-out packages; and feeding the web to suction collection means arranged downstream of the cutting device through package removal means arranged between the cutting device and the suction device, said package removal means removing said packages from said web.

26. A method of manufacturing circular infusion packages comprising steps as follows:

producing a travelling two-ply web having a plurality of discrete infusion filled pockets each containing one of the measures of infusion;

cutting said two-ply web into said circular packages each including one of the pockets by passing the two-ply web through a cutting device having means for cutting out each said package such that waste web substantially surrounds the cut-out packages;

pushing said packages from said web; and feeding the waste web to suction collection means arranged downstream of the cutting device.

27. A method of manufacturing non-rectangular infusion packages comprising steps as follows:

producing a travelling two-ply web of porous tissue material having a plurality of discrete infusion filled pockets each containing one of the measures of infusion;

cutting said two-ply web into said non-rectangular packages each including one of the pockets by passing the two-ply web through a cutting device having co-operating co-rotating rollers with recess means which accommodate successive of the pockets and providing cutting means arranged around said recess means for cutting out each said package such that waste web substantially surrounds the cut-out packages; and removing said cut-out packages from the travelling two-ply web.

28. A method as claimed in claim 27, wherein said packages are circular.

29. Apparatus for manufacturing non-rectangular infusion packages comprising means for producing a travelling two-ply web of porous tissue material having a plurality of discrete pockets each containing a measure of infusion; means for cutting said two-ply web into said non-rectangular packages comprising a web-cutting device comprising a pair of opposed cutting rollers having a plurality of recess means for receiving therein a plurality of successive said pockets; cutting means provided on at least one of said rollers and associated with said recess means for cutting each said pocket into an individual package, said cutting means comprising a cutting edge which defines said non-rectangular shape for substantially an entire outer peripheral edge of each package, whereby waste web substantially surrounds said packages; and means for pushing said cut-out packages from said waste web.

30. The apparatus as claimed in claim 29 wherein said cutting means define a circular shape.

31. The apparatus in claim 29 or 30 wherein the cutting means leaves a frangible connection between each respective infusion containing pocket and the surrounding waste web, which frangible connection is broken by the pushing means as the package is removed from the web.

32. The apparatus as claimed in claim 29 or 30 wherein said pushing means comprise a reciprocating member.

33. The apparatus as claimed in claim 29 or 30 further comprising means for collection said waste web.

34. The apparatus as claimed in claim 33 wherein said waste web collecting means comprises suction means.

35. The apparatus as claimed in claim 33 wherein said waste web collecting means comprises rollers drivingly engaging the waste web.

36. Apparatus for manufacturing circular infusion packages comprising means for producing a travelling two-ply web of porous tissue material having a plurality of discrete pockets each containing a measure of infusion; means for cutting said two-ply web into said circular packages comprising a web-cutting device comprising a pair of opposed cutting rollers having a plurality of recess means for receiving therein a plurality of successive said pockets; cutting means provided on at least one of said rollers and associated with said recess means for cutting each said pocket into an individual package, said cutting means comprising a cutting edge which defines said circular shape for substantially an entire outer peripheral edge of each package, whereby waste web substantially surrounds said packages; package removal means engaging said packages to remove them from said web; and means for conducting the waste web away from the cutting means.

* * * * *